US006431797B2

(12) United States Patent
Greenberg

(10) Patent No.: US 6,431,797 B2
(45) Date of Patent: Aug. 13, 2002

(54) MASONRY RETAINER WALL SYSTEM AND METHOD

(75) Inventor: Harold H. Greenberg, Prescott, AZ (US)

(73) Assignee: Pyramid Retaining Walls, LLC, Prescott, AZ (US)

( * ) Notice: Subject to any disclaimer, the term of this patent is extended or adjusted under 35 U.S.C. 154(b) by 0 days.

(21) Appl. No.: 09/752,166

(22) Filed: Dec. 29, 2000

Related U.S. Application Data

(63) Continuation-in-part of application No. 09/332,084, filed on Jun. 14, 1999, now abandoned.

(51) Int. Cl.[7] ..... E02D 5/30

(52) U.S. Cl. ..... 405/284; 405/262; 52/293.2; 52/295

(58) Field of Search ..... 405/284, 286, 405/262; 256/19; 52/295, 587.1, 565, 566, 568, 169.9, 294, 293.2, 293.3

(56) References Cited

U.S. PATENT DOCUMENTS

| | | | | | |
|---|---|---|---|---|---|
| 957,048 | A | * | 5/1910 | Francis | 52/332 |
| 1,704,255 | A | * | 3/1929 | Lewis | 52/293.2 |
| 2,635,815 | A | * | 1/1953 | Black | 52/126.1 |
| 2,815,656 | A | * | 12/1957 | Klein et al. | 52/169.1 |
| 3,537,220 | A | * | 11/1970 | Ellis | 52/698 |
| 4,064,668 | A | * | 12/1977 | Carter | 52/295 |
| 4,353,194 | A | * | 10/1982 | Norton | 52/742 |
| 4,452,028 | A | * | 6/1984 | Norton et al. | 52/295 |
| 4,694,621 | A | * | 9/1987 | Locke | 52/79.13 |
| 4,706,428 | A | * | 11/1987 | McCoy et al. | 52/295 |
| 4,726,567 | A | * | 2/1988 | Greenberg | 52/196.9 |
| 4,750,306 | A | * | 6/1988 | Granieri | 52/205 |
| 4,821,483 | A | * | 4/1989 | Adams | 52/747 |
| 4,887,691 | A | * | 12/1989 | Rotondo | 52/295 |
| 4,982,550 | A | * | 1/1991 | Vidal et al. | 52/295 |
| 5,007,218 | A | * | 4/1991 | Bengston et al. | 52/295 |
| 5,144,779 | A | * | 9/1992 | Vidal et al. | 405/284 |
| 5,524,405 | A | * | 6/1996 | Byrd | 52/295 |
| 5,564,865 | A | * | 10/1996 | Jansson | 405/286 |
| 5,782,048 | A | * | 7/1998 | Ramirez | 52/295 |
| 5,794,921 | A | * | 8/1998 | Greenberg | 52/295 |
| 5,890,332 | A | * | 4/1999 | Skidmore et al. | 52/295 |
| 6,061,986 | A | * | 5/2000 | Canada | 52/565 |

* cited by examiner

*Primary Examiner*—Thomas B. Will
*Assistant Examiner*—Alexandra K. Pechhold
(74) *Attorney, Agent, or Firm*—Cahill, Sutton & Thomas P.L.C.

(57) ABSTRACT

A masonry retaining wall is constructed using a footer placed at or beneath a lower grade level with vertically extending post-tensioning rods extending therefrom. The post-tensioning rods are provided with upset ends and flange members close to a right angle bend to provide appropriate anchoring in the footer and to increase the pull out strength of the rod. A plurality of courses of masonry block are positioned on the footer with the vertically extending post-tensioning rods threaded through voids in the block. Flange members are positioned on the ends of the respective post-tensioning rods and nuts are used on the threaded ends thereof to apply a predetermined tensioning force to each of the post-tensioning rods.

13 Claims, 2 Drawing Sheets

MASONRY RETAINER WALL SYSTEM AND METHOD

This application is a continuation-in-part of copending application Ser. No. 09/332,084 filed Jun. 14, 1999, now abandoned for "Masonry Retainer Wall System and Method".

FIELD OF THE INVENTION

The present invention relates to a masonry block system for utilization as a retaining wall for retaining soil behind the wall.

DESCRIPTION OF THE PRIOR ART

The utilization of masonry fences as retaining walls is well known in the prior art; however, the significant pressures caused by the soil bearing upon the wall surface requires prior art masonry walls to incorporate a significant amount of steel in the form of re-enforcing bars extending through the voids in the masonry block into a footer. A variety of techniques have been used in the prior art in an attempt to strengthen the wall and to provide sufficient resistance to the pressure caused by soil pressing against one side of the wall; these techniques are usually complicated and always expensive. Some prior art techniques have incorporated post-tensioning wherein courses of block have been compressed with respect to each other and the compressed courses are then secured in some manner to a foundation. These latter techniques usually require expensive installation provisions for appropriately supporting the compressed courses on the designated footer.

OBJECTS OF THE INVENTION

It is therefore an object of the present invention to provide a masonry retaining wall system that may be constructed relatively inexpensively and nevertheless retain strength to resist the forces of the soil pressing against one side thereof.

It is another object of the present invention to provide a retaining wall system wherein a very high strength wall is provided for retaining soil and which provides a base upon which a less expensive extending wall may be supported thereon.

It is still another object of the present invention to provide a retaining wall system that can be inexpensively constructed while providing all of the advantages of a retaining wall system while still providing an economical means for supporting a fence extending beyond the grade level of the soil being retained by the retaining wall.

It is still another object of the present invention to provide a method for constructing a retaining wall system.

It is still another object of the present invention to provide a retaining wall system incorporating post-tensioning wherein the courses of block within the retaining wall are compressed against the footer or foundation to provide a significant cost reduction in the construction of the retaining wall.

SUMMARY OF THE INVENTION

The present invention incorporates a masonry retaining wall structure that utilizes a footer for supporting a retaining wall's first course of masonry block to be positioned at the grade level of the lower grade of retaining wall system. Post-tensioning rods are imbedded in the footer concrete and incorporate an upset end and a flange member secured to the post-tensioning rod; the post-tensioning rod is angled upwardly and extended vertically from the footer. A plurality of courses of masonry block are then placed on the footer with the respective post-tensioning rods extending through the voids therein. The blocks are positioned with the post-tensioning rods closer to the side of the blocks contacted by the soil.

The post-tensioning rods extend upwardly beyond the top course of the masonry block. A plurality of bridging clamping plates extend across the voids of selected masonry blocks in the top course of blocks, each of the plates having an opening therein to permit the passage of an end of a respective post-tensioning rod. The end of the post-tensioning rod is threaded to accept a nut which is then placed on the rod and threaded to engage the clamping plate. Predetermined tension is then placed on the respective post-tensioning rods.

A cap course of blocks may be placed over the top course of masonry blocks to act as a protection for the threaded ends of the post-tensioning rods and the plates and nuts placed thereon.

This cap course may also form the foundation of a masonry wall, or fence, that extends above the retaining wall and above the grade level of the upper grade of the retaining wall system. The extending masonry fence may be constructed using conventional techniques with selected reinforcing bars extending through the retaining wall masonry blocks into the wall footer; alternatively, the extending fence may be constructed using post-tensioning techniques described and claimed in U.S. Pat. No. 4,726,567.

BRIEF DESCRIPTION OF THE DRAWINGS

The present invention may more readily be described by reference to the accompanying drawings in which.

DESCRIPTION OF THE PREFERRED EMBODIMENTS

Figure 1:
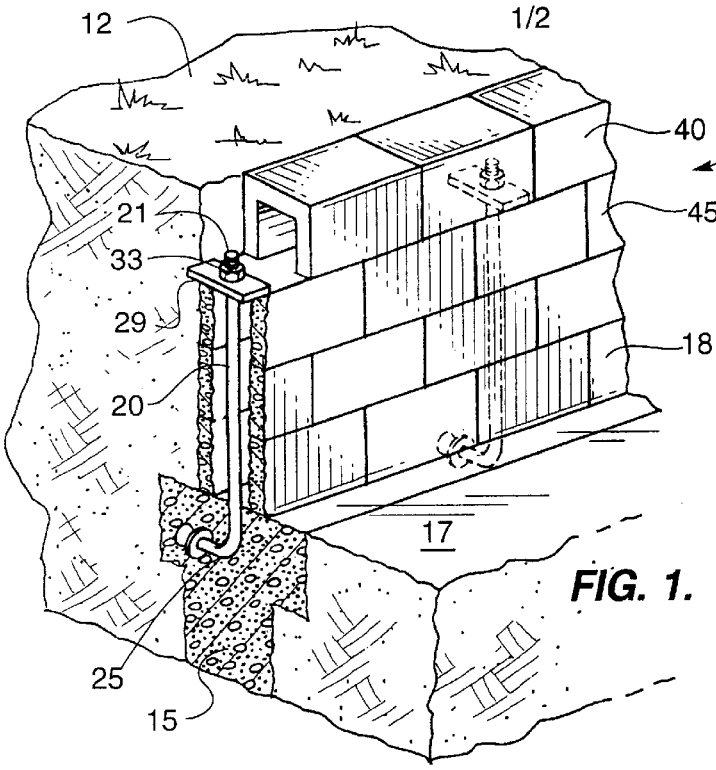
FIG. 1 is a perspective view of a retaining wall system constructed in accordance with the teachings of the present invention.
Figure 2:
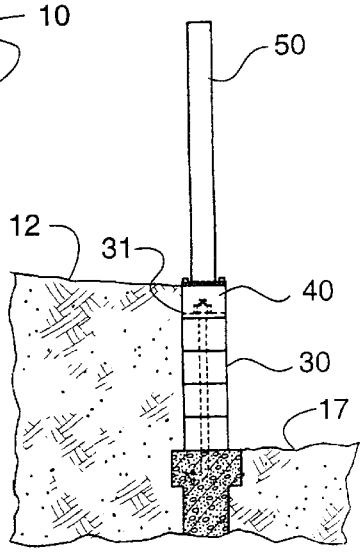
FIG. 2 is a sectional view of the retaining wall constructed in accordance with the teachings of the present invention, and showing an upwardly extending masonry fence extending above the upper grade of the retaining wall system.
Figure 3:
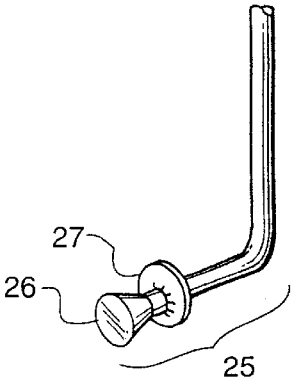
FIG. 3 is a perspective view of the end of a post-tensioning rod used in the present invention showing the upset end of the rod and a flange member positioned at the end of the rod before the rod is imbedded in the concrete.

Referring now to FIGS. 1, 2 and 3, a masonry block retaining wall 10 constructed in accordance with the teachings of the present invention is shown. The retaining wall system is intended to retain the soil extending below an upper or surface grade level 12 behind the system. A footer 15 is poured below a lower grade level 17 of the soil and provides the support for the retaining wall system.

The lower course 18 of the retaining wall is placed on the footer 15 while post-tensioning rods 20 are imbedded in the footer concrete while the latter is plastic The post-tensioning rods are spaced at predetermined horizontal intervals to register with the voids in masonry block and extend vertically upwardly terminating in respective threaded sections 21.

The lower portion 25 of each of the post-tensioning rods is placed at a right angle as shown and is also provided with upset ends 26 that may be formed by peening either at a factory or at the job site; further, each of the post-tensioning rods 25 is provided with a flange member 27 adjacent the end of the rod that may take the form of a large washer as shown and may also be secured to the rod such as by welding. The combination of the peening or upsetting of the end 26 of the post-tensioning rod and the flange member 27 provide an extremely high "pull out" strength. When the tensioning on the respective post-tension rods is very high, it is entirely possible to literally pull the rod out from the footer even though the footer concrete is set. The upset end and flange member provided on each imbedded end of the respective post-tensioning rods provide an appropriate anchoring system to prevent the post-tensioning rod from being withdrawn even if substantial tension is applied thereto. It is also possible to use other than a right angle or 90 degree bend in the embedded portion of the post-tensioning rods; other angles may be used. In some circumstances, the flange member may be increased in diameter to provide sufficient "pull out" strength to eliminate the necessity of providing a bend in the rod.

The post-tensioning rods 20 extend upwardly through voids in successive courses of masonry block and terminate in threaded ends 21. It may be noted that the successive courses of block in the retaining wall are arranged in overlapping or staggered configuration with respect to preceding courses of block; that is, to facilitate the transfer of compressive forces exerted on the retaining wall by the post-tensioning rods, the blocks of successive courses are staggered so that they overlap with courses immediately there below to transfer the compressive force from one course to the other. The spacing between adjacent vertically extending post-tensioning rods will depend on the strength necessary for the retaining wall to retain the soil pushing against one side thereof. Further, it may be possible to increase the width of the individual masonry blocks, perpendicular to the retaining wall, to resist tipping or bending forces applied to the wall.

Each of the vertically extending post-tensioning rods extends through a corresponding hole in a clamping plate 29 that bridges the gap between the opposing walls 30 and 31 of the respective masonry block in the top course of the retaining wall. The hole provided in the respective clamping plates permits the individual post-tensioning rods to extend therethrough and to accept a tightening nut 33 thereon. The respective nuts are then tightened to a predetermined post-tensioning rod tensile value to provide substantial compressive force to create a retaining wall of substantial strength at substantially less cost than a retaining wall of identical strength but constructed in accordance with prior art techniques.

A course of cap blocks 40 may be placed over the upper most course of the retaining wall to protect the exposed ends of the post-tensioning rods as well as the plates and nuts. Soil is then placed against the chosen side of the retaining wall up to the retained soil grade level 12.

The upper most course 45 of the retaining wall (excluding the top course of cap blocks) also forms the basis for an extension wall 50 that extends above the upper grade level of the soil retained by the retaining wall. This extension wall 50 may be formed using conventional techniques such as by extending reinforcing bar through the voids in the retaining wall into the footer and filling those voids in the retaining wall and the extension wall with mortar; alternatively, the extension wall can be supported using post-tensioning techniques in accordance with the teachings of the above mentioned patent. Further, a variety of prior art masonry wall techniques may be used for the extension wall including the use of interlocking or tongue and groove-type masonry blocks. It is also possible to construct the extension wall using masonry pillars with conventional wooden or iron slats extending between the respective pillars.

The method of the present invention incorporates the formation of a footer below a first grade with the upper surface of the footer at or slightly below that grade. A plurality of post-tensioning rods are positioned in the footer while still in plastic condition, and extending each of the post-tensioning rods vertically. A plurality of courses of masonry block are then placed on the footer with the respective post-tensioning rods extending through voids in the individual block. When the final course of the retaining wall is completed, a plurality of clamping plates are placed over the ends of the post-tensioning rods with the rods extending through holes provided in the respective plates and are positioned so as to bridge the void in the respective masonry block extending from the front to the rear surface thereof. A nut is then threaded on the threaded end of the post-tensioning rod and the rod is tensioned to provide a predetermined force on the retaining wall. A cap course is then placed on the upper most course of the retaining wall to provide a means for protecting and covering the exposed ends of the vertically extending tensioning rods and plates. The cap course may be applied in a conventional manner with mortar using prior art techniques. Soil is then placed behind the retaining wall up to the desired upper level grade of the system.

An extension wall, or fence, may then be constructed by extending selected vertically extending tension rods upwardly through voids in the masonry block forming the extension wall. Clamping plates and nuts are then positioned over the threaded ends of the post-tensioning rod and the rod tensioned to a predetermined value. It is important to note that only selected ones of the vertically extending post-tensioning rods are used to provide the necessary tensioning force for the extension wall since the latter is not called upon to withstand the forces exerted by soil abutting a surface of the retaining wall. Thus, depending on the necessary strength of the retaining wall, every third or every fourth post-tensioning rod extends upwardly into the voids of the masonry block forming the extension wall. In another embodiment, the method includes the formation of an extension wall using rebar extending through the voids of the retaining wall upwardly through the voids of the extension wall and anchoring the rebar in a conventional manner in the footer as well as locking the rebar to the extension wall using known prior art techniques such as grouting.

Figure 4:
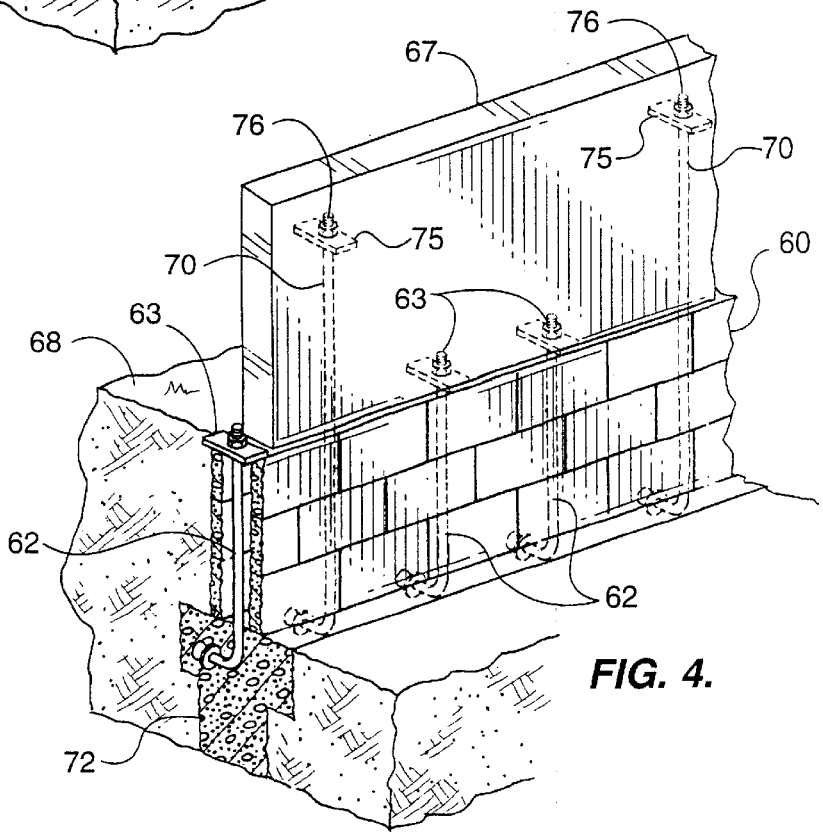
FIG. 4 is a perspective view of a portion of a retaining wall system constructed in accordance with the teachings of the present invention including an extension wall formed as part of the wall system.

Referring to FIG. 4, a retaining wall system constructed in accordance with the teachings of the present invention and incorporating an extension wall is shown. The retaining wall 60 is formed in a manner previously described including the utilization of a plurality of post-tensioning rods 62, each of which extends vertically and is provided with a respective clamping plate 63 and a nut on the threaded end of the rod to provide the required tension. An extension wall 67 is then constructed beginning at the second grade level 68 and extending upwardly to a desired height. The extension wall 67 is formed masonry block which may be formed of masonry block having less width than the retaining wall since less strength is required. In the embodiment chosen for illustration in FIG. 4, selected post-tensioning rods 70 extend upwardly from the footer 72 through voids in the masonry block forming the retaining wall 60 and through voids in the masonry block forming the extension wall 67. In a manner similar to that described previously, these selected vertically extending post-tensioning rods are provided with plates 75 and corresponding nuts 76 that are used to provide the appropriate post-tensioning tension within the respective post-tensioning rods. It may be noted that only selected post-tensioning rods extend upwardly into the extension wall; that is, the necessary strength of the retaining wall 60 required a predetermined number of vertically extending post-tensioning rods to provide the necessary strength for the retaining wall to resist the forces exerted by the soil extending upwardly to the higher grade or second grade level 68. The extension wall 67 is not required to withstand the force of the soil abutting against a surface thereof; therefore, only selected ones of the post-tensioning rods need to be extended through the voids in the extension wall.

Alternatively, the vertically extending post-tensioning rods 70 may be selected to be different than those rods used for post-tensioning of the retaining wall. That is, the post-tensioning rods for the extension wall 67 can be anchored through the use of anchoring plates positioned between courses within the retaining wall 60 and extending upwardly to clamping plate positioned at the top of the extension wall. Thus, the latter configuration would have a plurality of vertically extending post-tensioning rods extending from the footer upwardly to plates positioned at the top course of the retaining wall; however, substantially fewer post-tensioning rods would be anchored in the top course of the retaining wall and extend upwardly to the top course of the extension wall. In this manner, the extension wall is provided with the requisite strength which, however is significantly lower than the strength required of the retaining wall. The utilization of the selected extended post-tensioning rods to secure the extension wall above the retaining wall avoids the necessity of securing rods separately for the extension fence extending downwardly into the foundation; further, it avoids the expensive alternative of creating a bond beam in the top courses of the retaining wall to provide a means for attaching the tension rods for the fence on top of the retaining wall below. The masonry blocks used in the retaining wall of the present invention could be interlocking with a mortarless head joint. The mortar on the bed joints could be left off as well under certain circumstances. One of the purposes of the bed joint mortar is leveling of the courses; if leveling is not required, or if the block dimensions are so precise that they are self leveling or if some other leveling method is used, then bed joint mortar may be left off. Bed joint or head joint mortar is not required for strength since that is supplied by the post-tensioning.

Figure 5:
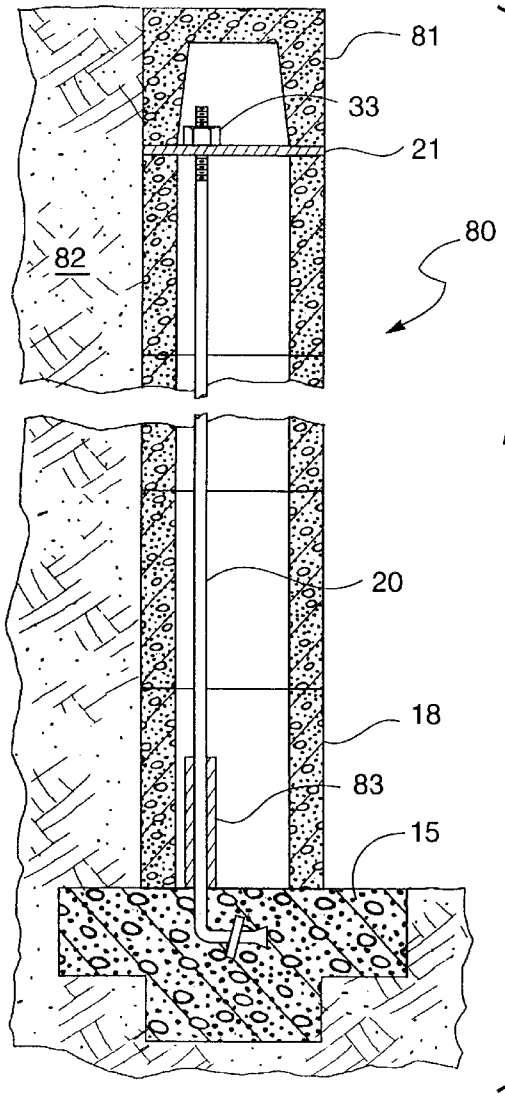
FIG. 5 is a foreshortened vertical sectional view of a soil retaining system embodying a modification of the invention.

FIG. 5 illustrates another modification of the soil retaining system of this invention. This system, indicated generally by reference numeral 80 comprises a footer 15. The lower course 18 of the retaining wall is placed on the footer while the lower ends of post-tensioning rods 20 are embedded in the footer 15 when the latter is plastic.

Unlike the previously described embodiments, however, the rods 20 are not centered in the blocks 18 but are offset to be closer to that side 81 of the wall contacted by the soil 82. With this configuration when the nuts 33 are tightened on their respective clamping plates 29 the compressive forces are transmitted more directly to that side 81 of the wall contacted by the soil 82 and which must resist the persistent static loads and intermittent lateral loads on the wall. The intermittent loads may be caused by heavy vehicles running over the soil nearby.

A significant advantage of the hollow block post tensioned structure is that it offers very little opportunity for ground water seeping into the structure to exit the opposite side and produce efflorescence. Consequently little if any waterproofing need be applied to the soil side of the structure, thereby reducing the cost of construction.

It is, however, likely that some moisture may enter the interior of the structure and puddle in the interior of the lower course of blocks 18. To preclude this moisture from having a deleterious effect on the post-tensioning rods 20 a lower region of the rods immediately above the footer 15 is preferably coated, or wrapped, or embedded in a water-proof covering 83.

Figure 6:
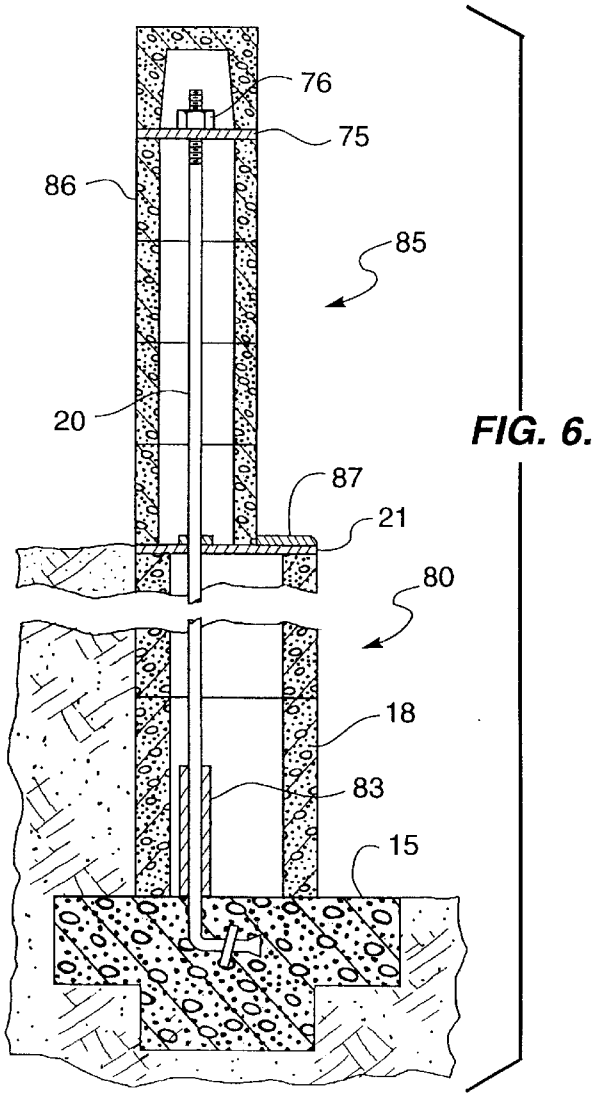
FIG. 6 is a foreshortened vertical sectional view of a soil retaining system with a masonry fence erected thereon.

FIG. 6 illustrates the manner in which an extension fence, or wall, 85 can be mounted atop the system 80 of FIG. 5. Because fence 85 can be subjected to intermittent lateral loads, or forces, from either side it is desirable that the post-tensional rods 20 extend up through the central regions of the courses of fence blocks 86. To achieve this the fence blocks 86 are preferably of less width than the blocks in the system 80 therebeneath. Thus, when the nuts 76 are tightened on the plates 75 the fence structure is compressed evenly to resist loads from either side.

The one disadvantage of employing narrower blocks 86 in the fence 85 is that this leaves exposed to the elements of weather portions of the plates 21 in the structure below. To remedy this condition the exposed regions of the plates 21 are provided with a weather-proof coating or covering 87.

The present invention has been described in terms of selected specific embodiments incorporating details to facilitate the understanding of the principles of construction and operation of the invention. Such reference herein to specific embodiments and details thereof are not intended to limit the scope of the claims appended hereto. It will be apparent to those skilled in the art that modifications may be made without departing from the spirit and scope of the invention.

What is claimed is:

1. A soil retaining system for a body of soil having an upper grade level at its surface and a lower grade level beneath its surface, said system comprising:

a footer positioned at or below the lower grade level of the soil;

a plurality of vertically extending post-tensioning rods having one end of each anchored in said footer;

a plurality of courses of masonry blocks having voids therein passing around the respective vertically extending post-tensioning rods;

a plurality of clamping plates, one each positioned to permit a corresponding one of said vertically extending post-tensioning rods to extend therethrough and positioned to bridge the void in a corresponding masonry block;

a plurality of nuts, each threaded on a different one of said post-tensioning rods to apply force to said clamping plate and to post-tension said rods;

the soil being in contact with one face of substantially all of the courses of masonry block;

said post-tensioning rods being offset within said courses of masonry blocks toward the face of the blocks in contact with the soil.

2. The system set forth in claim 1 wherein each of said post-tensioning rods incorporates a bend at that portion thereof that extends into said footer; and wherein the end of each of the post-tensioning rods imbedded in said footer is upset and has a flange member secured thereto adjacent said upset end.

3. The system set forth in claim 1 further including an extension fence extending vertically from the upper most course of blocks above said upper grade level.

4. The system set forth in claim 2 further including an extension fence extending vertically from the upper most course of blocks above said upper grade level.

5. The system set forth in claim 1 further including a water-proof covering on the regions of said post-tensioning rods immediately above the footer.

6. The system set forth in claim 2 further including a water-proof covering on the regions of said post-tensioning rods immediately above the footer.

7. The system set forth in claim 1 further including a fence erected above the system, said fence comprising a plurality of courses of masonry fence blocks surrounding extensions of certain of said post tensioning rods;

said fence blocks being narrower than said system blocks and being centered on said post tensioning rods.

8. the system and fence set forth in claim 7 wherein regions of said clamping plates not covered by fence blocks are coated with a weather-proof material.

9. A method for retaining a body of soil having an upper grade level at its surface and a lower grade level beneath the surface, the method comprising the steps of forming a footer at or below the lower level;

positioning each of a plurality of post-tensioning rods vertically at predetermined horizontal intervals with flange members of each rod extending into said footer when the latter is in plastic form;

forming a plurality of courses of masonry blocks with the voids in each block threaded over the respective vertically extending post-tensioning rods, and with the post-tensioning rods offset within the course of masonry blocks toward the faces of the blocks to be in contact with the soil;

placing a plurality of clamping plates, each over a different one of said vertically extending post-tensioning rods to bridge the void in a respective masonry block;

placing a plurality of nuts, each on a different threaded end of a post-tensioning rod and tightening said nut to provide a predetermined tension in said post-tension rod; and placing the soil against a face of said masonry blocks to the upper grade level.

10. The method of claim 9 further comprising the step of positioning a plurality of cap blocks on the uppermost course of said masonry blocks to protect exposed post-tensioning rod ends, nuts and clamping plates.

11. The method of claim 9 further comprising the step of providing a water-proof covering for the regions of the post-tensioning rods immediately above the footer.

12. The method of claim 9 further comprising the step of constructing a fence on the uppermost course of masonry blocks of fence blocks which are narrower than the masonry blocks and centered on extensions of certain of said post-tensioning rods.

13. The method of claim 12 comprising the further step of providing a weather-proofing covering for portions of said clamping plates not covered by said fence.

* * * * *